US006707659B2

(12) United States Patent
Hee

(10) Patent No.: US 6,707,659 B2
(45) Date of Patent: Mar. 16, 2004

(54) HEEL GROUNDER

(76) Inventor: Roland Hee, 88-11-01 Silverton Condominium, Gurney Drive, Penang 10250 (MY)

( * ) Notice: Subject to any disclaimer, the term of this patent is extended or adjusted under 35 U.S.C. 154(b) by 0 days.

(21) Appl. No.: 10/174,023

(22) Filed: Jun. 18, 2002

(65) Prior Publication Data

US 2003/0231454 A1 Dec. 18, 2003

(51) Int. Cl.[7] ..... H05F 3/00
(52) U.S. Cl. ..... 361/223; 361/224
(58) Field of Search ..... 361/223, 224, 361/220, 212

(56) References Cited

U.S. PATENT DOCUMENTS

| | | | |
|---|---|---|---|
| 1,531,862 | A | 3/1925 | Larned |
| 2,586,747 | A | 2/1952 | Van Atta et al. |
| 2,928,100 | A | 3/1960 | Gagnon |
| 2,955,234 | A | 10/1960 | Price |
| 2,998,697 | A | 9/1961 | Augenstein |
| 3,063,447 | A | 11/1962 | Kirsten |
| 3,377,509 | A | 4/1968 | Legge |
| 3,422,460 | A | 1/1969 | Burke et al. |
| 3,424,698 | A | 1/1969 | Lupinski et al. |
| 3,459,997 | A | 8/1969 | Legge |
| 3,541,389 | A | 11/1970 | Van Name |
| 3,582,448 | A | 6/1971 | Okuhashi et al. |
| 3,596,134 | A | 7/1971 | Burke |
| 3,699,590 | A | 10/1972 | Webber et al. |
| 3,810,258 | A | 5/1974 | Mathauser |
| 3,812,861 | A | 5/1974 | Peters |
| 3,832,841 | A | 9/1974 | Cole |
| 3,851,456 | A | 12/1974 | Hamada et al. |
| 3,857,397 | A | 12/1974 | Brosseau |
| 3,904,929 | A | 9/1975 | Kanaya et al. |
| 3,949,129 | A | 4/1976 | Hubbard |
| 3,986,530 | A | 10/1976 | Maekawa |

(List continued on next page.)

FOREIGN PATENT DOCUMENTS

| | | |
|---|---|---|
| DE | 2547390 | 5/1977 |
| DE | 3622948 | 1/1988 |
| GB | 0791199 | 2/1958 |
| GB | 1067260 | 5/1967 |

OTHER PUBLICATIONS

"Magnetic Ground Strap Connector", Technical Digest, No. 76, Mar. 1985, p. 21.
ESD Control Products, "Trustat" Footware and Grounding Accessories, SIMCO, p. 39 and TRUSTAT Conductive Wrist Straps and Ground Leads, p. 40, no date.
Westek Electrostatics, "Leg and Shoe Grounders", p. 8 and Personnel Grounding, p. 7, no date.

*Primary Examiner*—Anthony Dinkins
*Assistant Examiner*—Eric Thomas
(74) *Attorney, Agent, or Firm*—Stetina Brunda Garred & Brucker

(57) ABSTRACT

There is provided an improved heel grounding device for dissipating electrical voltages from a wearer to a ground. This device has first and second anchor plates which are adapted to be retained about the wearer's shoe. An elongate conductive strap is extended between the first and second anchor plates around the shoe's heel portion. Fasteners such as rivets are used to attach the conductive strap to the anchor plates. In this respect, the wearer can always check for proper dissipation of electrical voltages by visually confirming that the attachment between the conductive strap and the anchor plates via the fasteners remains intact.

26 Claims, 2 Drawing Sheets

U.S. PATENT DOCUMENTS 3,987,613 A 10/1976 Woods et al.
4,025,964 A 5/1977 Owens
4,112,941 A 9/1978 Larimore
4,211,456 A 7/1980 Sears
4,267,233 A 5/1981 Tanaka et al.
4,321,789 A 3/1982 Lammann et al.
4,373,175 A 2/1983 Mykkanen
4,398,277 A 8/1983 Christiansen et al.
4,402,560 A 9/1983 Swainbank
4,420,529 A 12/1983 Westhead
4,422,483 A 12/1983 Zins
4,453,294 A 6/1984 Morita
4,459,633 A 7/1984 Vandermark
4,475,141 A 10/1984 Antonevich
4,551,783 A 11/1985 Cohen et al.
4,577,256 A 3/1986 Breidegam
4,639,825 A 1/1987 Breidegam
4,676,561 A 6/1987 Barrett, II
4,677,521 A 6/1987 Frazier
4,847,729 A 7/1989 Hee
4,878,148 A 10/1989 Hee
5,004,425 A 4/1991 Hee
5,184,275 A 2/1993 Wiegel et al.
5,191,505 A 3/1993 Gordon et al.
5,576,924 A 11/1996 Hee
5,786,977 A * 7/1998 Cohen ..... 361/223

* cited by examiner

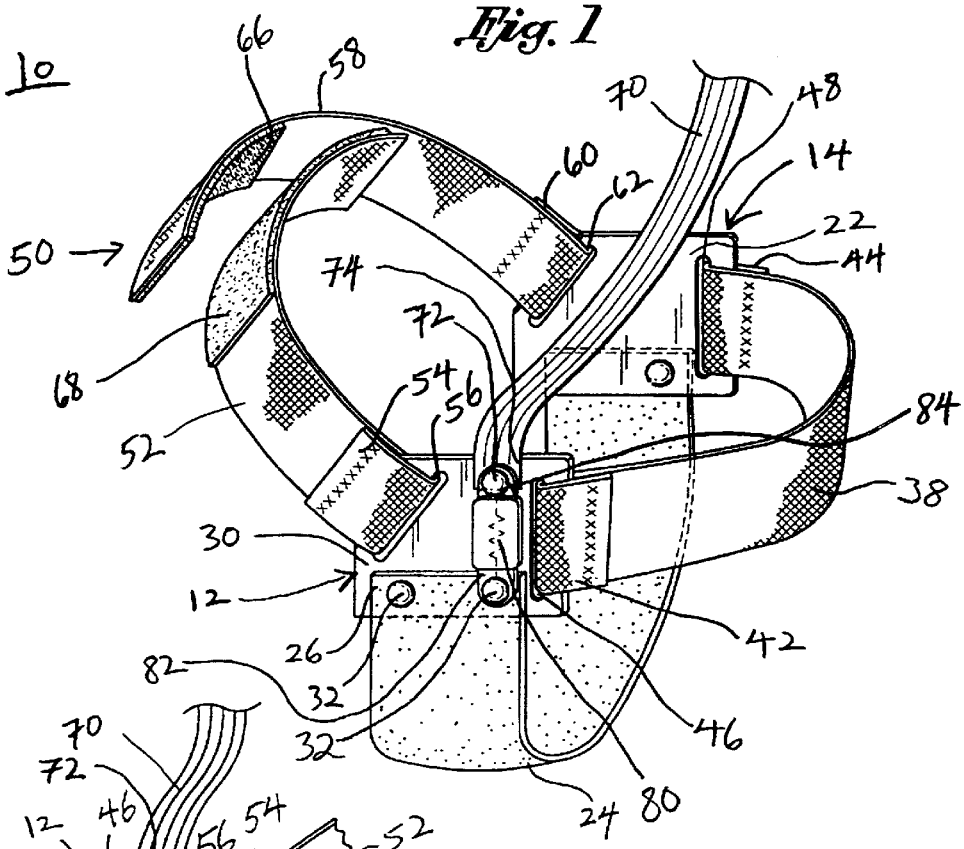
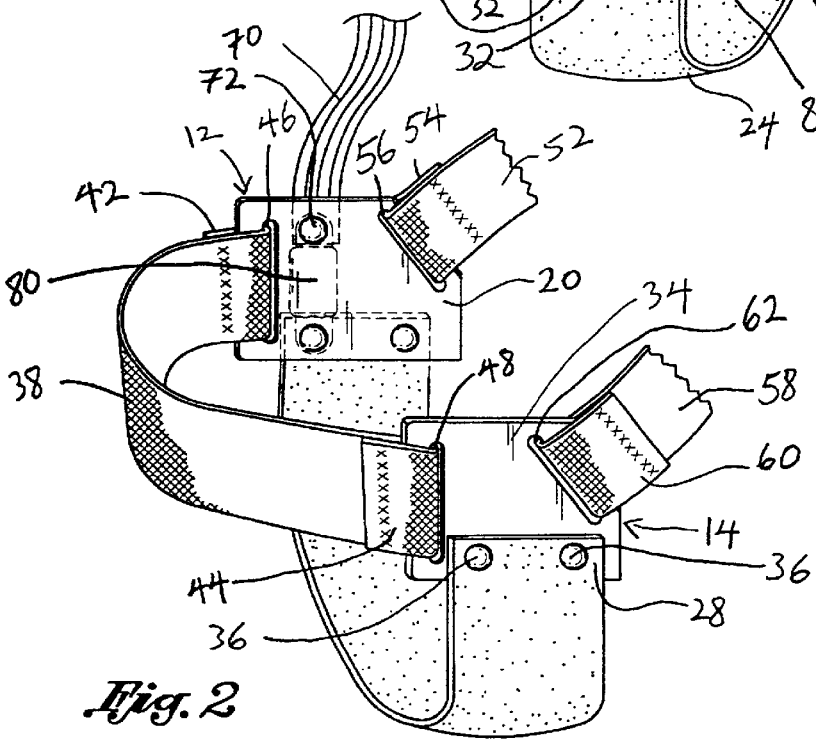
Fig. 2

HEEL GROUNDER

CROSS-REFERENCE TO RELATED APPLICATIONS (Not Applicable)

STATEMENT RE: FEDERALLY SPONSORED RESEARCH/DEVELOPMENT (Not Applicable)

BACKGROUND OF THE INVENTION

The present invention relates generally to heel grounders, and more particularly to an improved heel grounding device which allows its wearer to visually check for proper dissipation of electrical voltages to ground simply by observing the fasteners such as rivets holding the assembly of parts together remain intact.

In the assembly of electronic components, a major threat to the quality of such assemblies is the electrical potential difference existing between the electrical part assembly and the operator which may cause the part to be damaged. The typical solution to this electrostatic discharge problem in the work place has been to provide an environment which is substantially at a zero electrical potential. Electrostatic-free environments are typically created by providing workers and work stations with anti-static carpets, conductive or dissipative grounded desk top work surfaces, and/or hot air ion generators which emit ions to neutralize static charges.

Although such environments have proved to be generally useful in alleviating the electrostatic discharge problem, they do not typically have the degree of effectiveness that is desired by the manufacturers. Specifically, electrostatic-free environments fail to directly ground the workers themselves to a zero electrical potential. In this regard, electrically conductive bracelets have been implemented within such environments to sustain the workers at the zero electrical potential. However, these bracelets suffer from the disadvantage of limiting worker movement between work stations.

As such, various footwear grounding devices have been developed which can conduct electrical charges to ground while allowing the workers substantially unlimited mobility throughout the work place. A typical footwear is a heel grounder which is generally formed of a conductive rubber band and an elastic counter band or garter band. The prior art heel grounder further includes a fabric grounding tab generally of a woven polyester material coated with a conductive elastomer (such as neoprene loaded with 30% carbon), or alternatively metallic thread (such as silver yarn) is interwoven into the fabric of the grounding tab. It also includes a plastic fastening strap typically having a hoop and loop fastener, as well as a one-meg ohm chip resistor for providing additional safety of the worker against electric shock.

Though such currently known and available heel grounders may achieve their primary objective of properly grounding the workers, they possess certain deficiencies which detract from their overall utility. Perhaps the greatest deficiency of the prior art heel grounders lies in the method of their construction.

In the existing construction, the biggest problem is that all parts such as conductive rubber band and garter band are integrated and sewn together. In other words, all the parts forming the heel grounder are sewn and hidden among each other. However, if the sewing thread becomes loose and broken during use, then electrical continuity between the parts also become broken. Such occurrence inevitably leads to the undesired effect of destroying the conduction of electrical charges between the worker and earth ground.

The parts of the heel grounder need not come apart fully in order to destroy the charge conduction as loosening of the threads is generally sufficient to break continuity. This is where most of the electronic components are damaged. If the parts do not fall apart from each other, there is no way for the worker to know there is a problem unless the heel grounder is checked using a heel grounder tester. This is not practical and generally not done especially when the worker is in the middle of assembly. Hence, various electronic components become unintentionally damaged no matter how much effort was expended in providing a electrostatic-free environment.

Thus, there exists a substantial need in the industry, and in the microelectronics business in particular, for a heel grounding device that enables workers to quickly and accurately check for proper dissipation of electrical voltages irrespective of the work stage they are in. More specifically, there exists a need for a visually apparent heel grounding device which allows the workers to easily and rapidly visually check for proper electrical condition in a user-friendly manner.

BRIEF SUMMARY OF THE INVENTION

The present invention specifically addresses and alleviates the above-referenced deficiencies associated with the use of the heel grounders of the prior art. More particularly, the present invention comprises an improved heel grounding device which allows its wearer to quickly, visually check for proper dissipation of electrical voltages to the earth ground. As will become more apparent below, this is accomplished by visually verifying that the assembly of parts forming the present heel grounding device through the use of fasteners such as rivets remains intact.

In accordance with a preferred embodiment of the present invention, there is provided a grounding device which can be worn around a shoe in order to dissipate electrical voltages from the wearer to the earth ground. The heel grounding device of the present invention preferably utilizes two plastic anchor plates which are adapted to be maintained on opposing side portions of the wearer's shoe. An elongate electrically conductive strap preferably fabricated from rubber is formed between the anchor plates and is designed to extend around the heel portion of the wearer's shoe. Such conductive strap is preferably riveted to the plastic anchor plates.

In the preferred embodiment of the present invention, the heel grounding device also features an elongate garter strap or band which is formed between the two plastic anchor plates. The garter strap helps to secure the grounding device to the wearer's shoe by extending around its rear portion. Preferably, the garter strap is fabricated from an elastic material.

An attachable/detachable hook-and-loop (Velcro.TM.) system is further defined between the two anchor plates to provide adjustable fastening of the grounding device to the wearer's shoe. Such system is comprised of a hook strip and a loop strip which extend outwardly from their respective anchor plates and are releasibly connected to each other around the upper portion of the wearer's shoe. As is well known, the hook strip's inner surface may be connected at any location along the outer surface of the loop strip in order to provide adjustable fastening.

In the preferred embodiment, a grounding tab is riveted to any one of the two plastic anchor plates and extends freely (i.e. dangles) therefrom. The exposed end of this tab maybe tucked inside the wearer's sock so as to touch his or her skin. The grounding tab is preferably made from fabric such as polyester which includes either are electrically conductive elastomer or metallic thread.

A chip resistor which is preferably used for preventing electric shocks which preferably is provided on the same plastic anchor plate that the grounding tab extends from. This chip resistor is formed between the points of rivet attachment of the conductive strap and the grounding tab as the same rivets are used to mount the resistor on the anchor plate. The chip resistor preferably comprises a one-meg ohm chip resistor.

In operation, the heel grounding device of the present invention is worn around the wearer's shoe by first placing the shoe's heel portion upon the elongate conductive strap. Thereafter, the shoe's rear portion should be closely abutted against the garter strap or band so that tensioning fit develops once the grounding device is fastened. The hook and loop strips are then extended around the shoe's upper portion and fastened, after which the grounding tab's exposed end is tucked inside the wearer's sock so as to touch his or her skin. Of course, the strips may be adjusted to accommodate differing sizes and styles of the shoes.

With the heel grounding device on, the wearer is effectively grounded to zero electrical potential. Hence, the wearer may stand or freely walk on the grounded conductive surface while performing his or her electronics assembling duties. Thus, there is no unintentional static discharge to the electronic components to cause damage.

Due to all of the electrical connections to the heal grounder being facilitated by the conductive rivets attached to the anchor plates which can be easily visually observed by a user during use the user can easily check for proper dissipation of electrical voltages simply by observing the rivets holding the assembly together remain intact. As such the present invention comprises a visually apparent/evident heel grounder which insures proper electrical grounding merely by quick visual observation of the rivets and on anchor plates.

BRIEF DESCRIPTION OF THE DRAWINGS

These as well as other features of the present invention will become more apparent upon reference to the drawings wherein:

FIG. 1 is, a perspective view of a heel grounding device constructed in accordance with a preferred embodiment of the present invention and illustrating its first anchor plate which attaches a conductive strap, a grounding tab and a chip resistor through the use of rivets;

FIG. 2 is a perspective view of the heel grounding device of FIG. 1 illustrating its second anchor plate which attaches the conductive strap through the use of rivets.

DETAILED DESCRIPTION OF THE INVENTION

Figure 3:
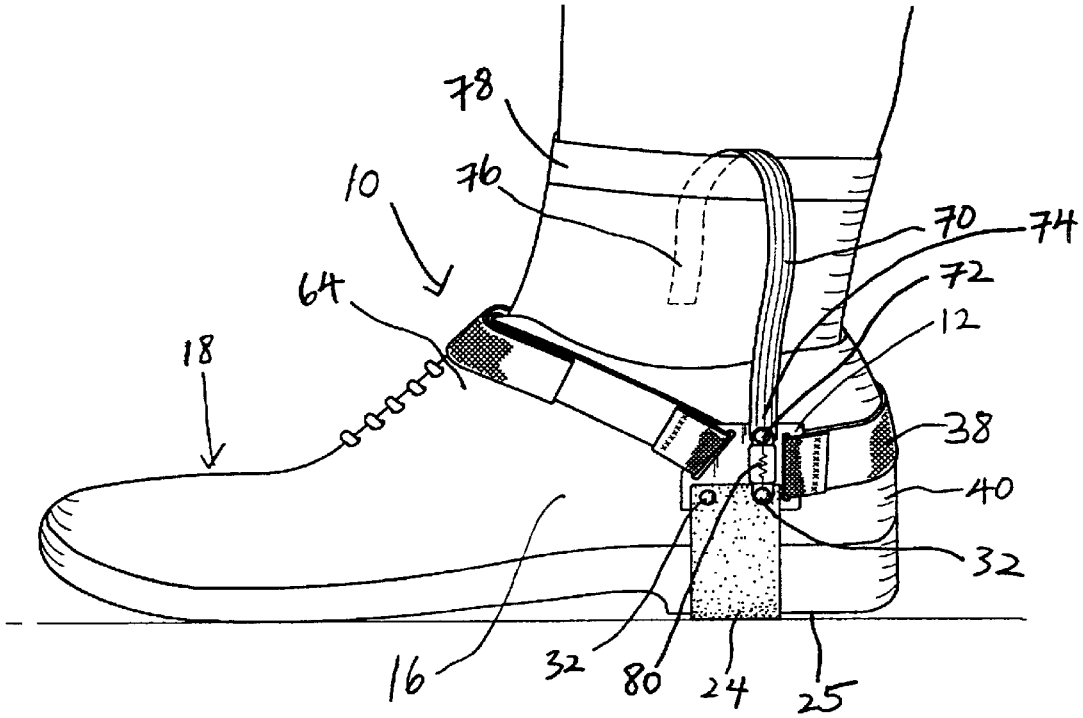
FIG. 3 is a side view of the heel grounding device of FIG. 1 which is worn around its wearer's shoe with the grounding tab's exposed end being tucked inside the wearer's sock.

Referring now to the drawings wherein the showings are for purposes of illustrating preferred embodiments of the present invention only, and not for purposes of limiting the same, FIG. 1 perspectively illustrates a heel grounding device 10 constructed in accordance with a preferred embodiment of the present invention. As indicated above, the present heel grounding device 10 allows its wearer to quickly visually check for proper dissipation of electrical voltages to the ground simply by observing that the fasteners such as rivets holding the assembly of parts together remain intact. As will be demonstrated below, this simple visually evident/apparent method of checking for proper voltage dissipation due to the unique construction of the heel grounding device 10 significantly mitigates unintentional static discharges to the electronic components to cause damage.

Referring more particularly to FIGS. 1 and 2, the heel grounding device 10 of the present invention is comprised of a first anchor plate 12 and a second anchor plate 14. Although the first and second anchor plates 12, 14 may be fabricated from any rigid or semi-rigid material, a polymer/plastic is the preferred material of choice. The anchor plates 12, 14 are adapted to be maintained on opposing side portions 16 of the wearer's shoe 18. In this configuration, the first and second anchor plates 12, 14 respectively define a first inner plate surface 20 and a second inner plate surface 22 which face toward their respective side portions 16 of the wearer's shoe 18.

An elongate conductive strap 24 is provided between the first and second anchor plates 12, 14. The conductive strap 24 is configured to tightly wrap around the heel portion 25 of the wearer's shoe 18 so that it effectively dissipates electrical voltages from the wearer. The elongate conductive strap 24 is preferably fabricated from an electrically conductive elastomeric material such as an electrically conductive rubber. Such material should provide a texture and thickness which would possess sufficient abrasion resistance and tear strength to withstand continued contact and sliding over the conductive flooring.

The conductive strap 24 is attached to the first and second anchor plates 12, 14 via a plurality of fasteners. More specifically, the conductive strap 24 defines a first conductive end 26 and a second conductive end 28. The first conductive end 26 is positioned against the first outer plate surface 30 of the first anchor plate 12 whereat the first fasteners 32 are then driven therethrough towards the first inner plate surface 20. Likewise, the second conductive end 28 is placed against the second outer plate surface 34 of the second anchor plate 14 so that second fasteners 36 are then inserted therethrough towards the second inner plate surface 22. Although any types of fasteners such as screws or pins may be used for this purpose, rivets are the preferred fasteners. Moreover, the number of fasteners to be used is irreverent, but preferably two on each anchor plate 12 or 14 has been found to be adequate to sturdily attach the conductive strap 24.

An elongate garter strap 38 is also provided between the first and second anchor plates 12, 14. As will be better illustrated below, the garter strap 38 helps in securing the heel grounding device 10 to the wearer's shoe 18 by extending around its rear portion 40. Preferably, the garter strap 38 is made from an elastic material so that it yields some degree of stretching when wrapped around the shoe's rear portion 40.

The garter strap 38 has a first garter end 42 and a second garter end 44. The first garter end 42 is first inserted through the first garter opening 46 defined on the first anchor plate 12 in which such end 42 attaches itself to the garter strap 38. Similarly, the second garter end 44 is inserted through the second garter opening 48 defined on the second anchor plate 14 and is then attached to the garter strap 38. The attachment of the first and second garter ends 42, 44 to their respective locations of the garter strap 38 may be accomplished in any manner. However, it is preferred that they are either sewn or ultrasonically welded to the garter strap 38.

The present heel grounding device 10 is further provided with an attachable/detachable system. preferably a hook-and-loop (Velcro.TM.) system 50 between the first and second anchor plates 12, 14. Such system 50 is designed to provide adjustable fastening of the grounding device 10 to the wearer's shoe 18. The hook-and-loop system 50 first comprises a loop strip 52 in which its first loop end 54 is inserted through the loop opening 56 defined on the first anchor plate 12. The first loop end 54 is then attached to any given location on the loop strip 52. The system 50 also includes a hook strip 58, the first hook end 60 of which is inserted through the hook opening 62 defined on the second anchor plate and thereafter attached to any location on the hook strip 58. Like the first and second garter ends 42, 44, the first loop and hook ends 54, 60 are attached via sewing or ultrasonic welding.

The loop and hook strips 52, 58 are designed to extend outwardly from their respective anchor plates 12, 14 and releasibly connect with each other around the upper portion 64 of the wearer's shoe 18. As is common with every hook-and-loop systems, the inner hook surface 66 of the hook strip. 58 may be connected at any location along the outer loop surface 68 of the loop strip 52 in order to provide adjustable fastening. Hence, the present heel grounding device 10 may fit well on nearly any conventional shoe, regardless of style or size. Although the hook and loop fastener system is preferred, those having ordinary skill in the art will recognize that alternative adjustable strap systems, such as buckle or button systems are contemplated herein.

The heel grounding device 10 of the present invention includes an elongate grounding tab 70 either at the first or second anchor plates 12 or 14. Choosing the first anchor plate 12 as its location, a tab fastener 72 preferably a rivet attaches the first grounding end 74 of the grounding tab 70 to the first anchor plate 12. By this sole attachment, the grounding tab 70 is left to extend freely (i.e. dangle). The exposed second grounding end 76 of the grounding tab 70 may be tucked inside the wearer's sock 78 so as to be placed in abutting electrical contact with the wearer's skin. The grounding tab 70 is preferably constructed from a fabric material such as polyester which includes either a conductive elastomer or metallic thread.

A chip resistor 80 which is used for preventing electric shocks to the wearer is provided on the same anchor plate 12 or 14 that the grounding tab 70. The chip resistor 80 is preferably positioned between the points of rivet attachment of the conductive strap 24 and the grounding tab 70 as the same rivets are used to mount the resistor 80 on the anchor plate 12 or 14. More particularly, the first resistor end 82 of the chip resistor 80 is disposed over the first conductive end 26 whereas its second resistor end 84 is positioned over the first grounding end 74. Preferably, the chip resistor 80 is a one-meg ohm chip resistor.

FIG. 3 shows the operation of the heel grounding device 10 of the present invention. As illustrated, the heel grounding device 10 is worn around the wearer's shoe 18 by first placing the shoe's heel portion 25 upon the elongate conductive strap 24. Thereafter, the shoe's rear portion 40 should be closely abutted against the garter strap 38 so that tensioning fit develops once the grounding device 10 is fastened. The loop and hook strips 52, 58 are then extended around the shoe's upper portion 64 and fastened, after which the exposed second grounding end 76 is tucked inside the wearer's sock 78 so as to touch his or her skin. Of course, the strips 52, 58 may be adjusted to accommodate differing sizes and styles of the shoes.

With the heel grounding device 10 on, the wearer is effectively grounded to zero electrical potential. Hence, the wearer may stand or freely walk on the grounded conductive surface while performing his or her electronics assembling duties. Thus, there is no unintentional static discharge to the electronic components to cause damage. To ensure that such electrical grounded condition is constantly maintained, the wearer can easily visually check for proper dissipation of electrical voltages simply by visually observing that the fasteners 32, 36, 72, namely, rivets holding the assembly together remain intact. As such the present invention comprises a visually evident i.e. apparent heel grounder which allows the user to quickly and reliably visually verify proper heel grounder function while maintaining the heel grounder disposed upon the users shoe.

Additional modifications and improvements of the present invention may also be apparent to those of ordinary skill in the art. Thus, the particular combination of parts describe and illustrated herein is intended to represent only certain embodiments of the present invention, and is not intended to serve as limitations of alternative device within the spirit and scope of the invention.

What is claimed is:

1. A grounding device for dissipating electrical voltages from a wearer to a ground when extended around a heel portion of a wearer's shoe, the device comprising:

first and second anchor plates sized and configured to be retained about the wearer's shoe;

attachable/detachable hook and loop strips formed between the first and second anchor plates for facilitating the device to be secured about the wearer's shoe in an adjustable manner; and an elongate conductive strap attached to the first anchor plate by at least one first fastener and extending around the heel portion of the wearer's shoe to be attached to the second anchor plate by at least one second fastener;

wherein attachment of the conductive strap to the first and second anchor plates with the at least one first and at least one second fasteners allows the wearer to visually confirm that dissipation of the electrical voltages from the wearer to the ground is maintained.

2. The device of claim 1 wherein the first and second anchor plates are each fabricated from plastic.

3. The device of claim 1 further comprising an elongate garter strap formed between the first and second anchor plates for facilitating the device to be secured about the wearer's shoe.

4. The device of claim 3 wherein the wearer's shoe defines a rear portion, and wherein the garter strap is engaged to the first anchor plate and extending around the rear portion of the wearer's shoe to be engaged to the second anchor plate.

5. The device of claim 3 wherein the first anchor plate has a first garter opening and the second anchor plate has a second garter opening, the garter strap having a first garter end which advances through the first garter opening prior to being engaged to the first anchor plate, the garter strap having a second garter end which advances through the second garter opening prior to being engaged to the second anchor plate.

6. The device of claim 5 wherein the first and second garter ends are ultrasonically welded to the garter strap after respectively advancing through the first and second garter openings.

7. The device of claim 1 wherein the elongate conductive strap is fabricated from an elastomeric material.

8. The device of claim 7 wherein the elastomeric material is rubber.

9. The device of claim 1 wherein the first anchor plate has a first outer plate surface and the second anchor plate has a second outer plate surface, the conductive strap having a first conductive end which is attached to the first outer plate surface, the conductive strap having a second conductive end which is attached to the second outer plate surface.

10. The device of claim 9 wherein the first anchor plate has a first inner plate surface and the second anchor plate has a second inner plate surface, the first conductive end being attached by fastening the at least one first fastener from the first outer plate surface towards the first inner plate surface, the second conductive end being attached by fastening the at least one second fastener from the second outer plate surface towards the second inner plate surface.

11. The device of claim 1 wherein the at least one first and at least one second fasteners are rivets.

12. The device of claim 1 wherein the wearer's shoe defines an upper portion, and wherein the hook and loop strips extend around the upper portion of the wearer's shoe when attached to each other.

13. The device of claim 1 wherein the first anchor plate has a loop opening and the second anchor plate has a hook opening, the loop strip having a first loop end which advances through the loop opening prior to being engaged to the first anchor plate, the hook strip having a first hook end which advances through the hook opening prior to being engaged to the second anchor plate.

14. The device of claim 13 wherein the first loop end is ultrasonically welded to the loop strip after advancing through the loop opening, the first hook end being ultrasonically welded to the hook strip after advancing through the hook opening.

15. The device of claim 1 further comprising a grounding tab extending from the first anchor plate.

16. The device of claim 15 wherein the grounding tab has a first grounding end which is attached to the first anchor plate by a tab fastener, the grounding tab having a second grounding end which is sized and configured to be disposed in abutting contact with the wearer.

17. The device of claim 16 wherein the tab fastener is a rivet.

18. The device of claim 16 further comprising a chip resistor formed at the first anchor plate for mitigating an electric shock to the wearer.

19. The device of claim 18 wherein the resistor has a first resistor end which is disposed over the conductive strap and attached to the first anchor plate by the first fastener(s), the resistor having a second resistor end which is disposed over the first grounding end and attached to the first anchor plate by the tab fastener.

20. A grounding device for dissipating electrical voltages from a wearer to a ground when extended around a heel portion of a wearer's shoe, the device comprising:

first and second anchor plates sized and configured to be retained about the wearer's shoe, the first anchor plate having a first garter opening and the second anchor plate having a second garter opening;

an elongate garter strap formed between the first and second anchor plates for facilitating the device to be secured about the wearer's shoe, the garter strap having a first garter end which advances through the first garter opening prior to being engaged to the first anchor plate, the garter strap having a second garter end which advances through the second garter opening prior to being engaged to the second anchor plate; and an elongate conductive strap attached to the first anchor plate by at least one first fastener and extending around the heel portion of the wearer's shoe to be attached to the second anchor plate by at least one second fastener;

wherein attachment of the conductive strap to the first and second anchor plates with the first and second fasteners allows the wearer to visually confirm that dissipation of the electrical voltages from the wearer to the ground is maintained.

21. The device of claim 20 wherein the wearer's shoe defines a rear portion, and wherein the garter strap is engaged to the first anchor plate and extending around the rear portion of the wearer's shoe to be engaged to the second anchor plate.

22. The device of claim 20 wherein the first and second garter ends are ultrasonically welded to the garter strap after respectively advancing through the first and second garter openings.

23. A grounding device for dissipating electrical voltages from a wearer to a ground when extended around a heel portion of a wearer's shoe, the device comprising:

first and second anchor plates sized and configured to be retained about the wearer's shoe;

a grounding tab extending from the first anchor plate, the grounding tab having a first grounding end which is attached to the first anchor plate by a tab fastener, the grounding tab having a second grounding end which is sized and configured to be disposed in abutting contact with the wearer; and an elongate conductive strap attached to the first anchor plate by at least one first fastener and extending around the heel portion of the wearer's shoe to be attached to the second anchor plate by at least one second fastener;

wherein attachment of the conductive strap to the first and second anchor plates with the first and second fasteners allows the wearer to visually confirm that dissipation of the electrical voltages from the wearer to the ground is maintained.

24. The device of claim 23 wherein the tab fastener is a rivet.

25. The device of claim 23 further comprising a chip resistor formed at the first anchor plate for mitigating an electric shock to the wearer.

26. The device of claim 25 wherein the resistor has a first resistor end which is disposed over the conductive strap and attached to the first anchor plate by the first fastener(s), the resistor having a second resistor end which is disposed over the first grounding end and attached to the first anchor plate by the tab fastener.

* * * * *